US012264898B2

(12) United States Patent
Couce

(10) Patent No.: US 12,264,898 B2
(45) Date of Patent: Apr. 1, 2025

(54) REMOTE TACTICAL GIMBAL TARGETING SYSTEM FOR SINGLE OR MULTIPLE ROCKET LAUNCHERS

(71) Applicant: Gonzalo Couce, Port Colborne (CA)

(72) Inventor: Gonzalo Couce, Port Colborne (CA)

(73) Assignee: INTEGRATED LAUNCHER SOLUTIONS INC. (CA)

( * ) Notice: Subject to any disclaimer, the term of this patent is extended or adjusted under 35 U.S.C. 154(b) by 133 days.

(21) Appl. No.: 18/202,832

(22) Filed: May 26, 2023

(65) Prior Publication Data

US 2023/0384059 A1 Nov. 30, 2023

Related U.S. Application Data

(60) Provisional application No. 63/346,184, filed on May 26, 2022.

(51) Int. Cl.

| | |
|---|---|
| ***F41G 5/16*** | (2006.01) |
| ***F41G 3/02*** | (2006.01) |
| ***F41G 3/06*** | (2006.01) |
| ***F41G 3/18*** | (2006.01) |
| ***F41G 3/22*** | (2006.01) |
| ***F41G 11/00*** | (2006.01) |
| *F41F 3/04* | (2006.01) |

(52) U.S. Cl.

CPC ..... *F41G 5/16* (2013.01); *F41G 3/02* (2013.01); *F41G 3/065* (2013.01); *F41G 3/18* (2013.01); *F41G 3/22* (2013.01); *F41G 11/00* (2013.01); *F41F 3/04* (2013.01)

(58) Field of Classification Search

CPC ... F41G 5/16; F41G 3/02; F41G 3/065; F41G 3/18; F41G 3/22; F41G 11/00; F41F 3/04

USPC ..... 89/37.01

See application file for complete search history.

(56) References Cited

U.S. PATENT DOCUMENTS

| | | | | |
|---|---|---|---|---|
| 7,185,575 | B1 * | 3/2007 | Collier | F41A 23/24 89/1.8 |
| 8,833,232 | B1 * | 9/2014 | Fox | F41G 3/165 89/41.14 |
| 9,523,548 | B2 * | 12/2016 | Fox | F41A 23/24 |
| 2009/0228159 | A1 * | 9/2009 | Flowers | F41G 7/226 701/3 |
| 2010/0116886 | A1 * | 5/2010 | Flowers | F41G 7/008 235/404 |
| 2020/0326156 | A1 * | 10/2020 | McNeil | F41G 3/20 |
| 2022/0120533 | A1 * | 4/2022 | Teetzel | G06G 7/80 |

* cited by examiner

*Primary Examiner* — Samir Abdosh

(74) *Attorney, Agent, or Firm* — Malloy & Malloy, P.L.; Robert M. Downey

(57) ABSTRACT

A remote weapon system structured to be interfaced with aerial, ground and sea vehicles or platforms for operation in mission critical conditions, allows for mounting and control of single or multi-shot anti-armor rocket launcher systems and provides optical sighting, laser range finding and fire control to adjust vertical elevation, sight of target and trigger of the ignition system. A tactical gimbal controlled by a high torque motor with dual shafts allows for high positional accuracy and target hold that is stable. A frame shrouds and secures rocket launcher tubes causing them to move in unison with the tactical gimbal as a single or multi-shot system. Ignition of the rocket(s) is achieved by a remote-controlled ignitor.

10 Claims, 5 Drawing Sheets

REMOTE TACTICAL GIMBAL TARGETING SYSTEM FOR SINGLE OR MULTIPLE ROCKET LAUNCHERS

This non-provisional patent application is based on provisional patent application Ser. No. 63/346,184 filed May 26, 2022.

BACKGROUND OF THE INVENTION

Field of the Invention

This invention relates to lightweight assault weapons and, more particularly, to a remotely operated lightweight anti-armor weapon system.

Description of the Related Art

The large-scale development and manufacturing of armored vehicles, and particularly tanks, began during World War II. As a result of the mass deployment of tanks onto the battlefield, there arose a need for weapons to combat these armored vehicles. This led to the development of various munitions that could be fired or launched from lightweight assault weapons, and particularly, lightweight anti-armor weapons systems. A significant lightweight anti-armor weapon system that was developed by NAMMO in the early 1960s was the M72 LAWS rocket launcher. Traditionally, the M72 LAWS rocket launcher and other lightweight assault weapons and anti-armor weapons have been designed as a shoulder supported weapon for operation by a soldier on the battlefield. And, while the M72 LAWS shoulder operated rocket launcher has been significantly improved over the years and is an important weapon on the battlefield, there are critical situations where the range to a target is within the reach of hostile fire, thereby placing soldiers at a significant risk for casualties. More specifically, one limitation of the M72 LAWS shoulder operated rocket launcher and other lightweight shoulder operated assault weapons is that there is an approximate forty yard backblast when firing the weapon that gives away the position of the soldier on the battlefield. Thus, when a soldier fires the shoulder supported M72 LAWS rocket launcher they don't even wait to see if they hit the target. They simply drop the weapon and run, as the enemy forces will open fire on that position as soon as they see the backblast from the soldier's fired rocket from the shoulder supported LAWS rocket launcher.

Accordingly, there remains a need for devices and systems that will allow for remote operation of the M72 LAWS rocket launcher and other similar anti-armor rocket launcher systems that can be operated remotely without endangering the lives of the weapon operators. Moreover, there is a need for a remote weapon station that can be integrated with the M72 LAWS rocket launcher in a manner that provides for mounting and firing from aerial, ground and sea vehicles or platforms in mission critical conditions.

SUMMARY OF THE INVENTION

The present invention is directed to a remote weapon station that provides a universally adaptive targeting system capable of operating on aerial, ground and sea vehicles or platforms in mission critical conditions. The remote weapon station, referred hereinafter as the remote tactical gimbal targeting system (RTGTS) is structured to be interfaced to vehicles or platforms utilizing the mil spec picatinny rail system, ARC rail, morse taper or similar high accuracy interface mounting mechanisms with quick release mechanical separation. It is designed to be completely modular and agnostic in its operation for situational mounting options. The remote tactical gimbal targeting system is completely self-powered and controlled from a remote location, and is adapted for mounting and control of single or multi shot launcher systems from the NAMMO developed line of M72 and A12 family of Lightweight Anti-Armor Weapons System (LAWS) rocket launchers.

Interfacing to several platforms allows the range of targeting to be adjusted in the field by an operator with toggle sticks on a visually displayed Ground Control System (GCS) and relayed feedback to a CPU. The remote weapon station uses optical sighting, laser range finding, fire control, and adjusts the tactical gimbal azimuth (left and right horizontal movement) and vertical elevation, all to sight the target and trigger the ignition system. Encryption software is also implemented to protect the remote weapon station's software from being overtaken or scrambled during operation. The GCS also offers up to 8 or more total channels to view and customize other components for the end user to integrate as desired or needed.

The tactical gimbal includes a high torque motor with dual shafts that has high positional accuracy and target hold that is stable. The top of the motor is mounted to a rigid metal structure that attaches directly to the picatinny rail, ARC rail, morse taper of other similar high accuracy interface quick release mount assembly and is easily secured or detached to the vehicle using a toolless or a readily available mil standard tool, such as a quarter turn or Allen key. A dual shaft arrangement operated by the motor controls the axis on which the M72 rocket launcher assembly rotates. The dual shafts on the motor are secured to a metal or composite frame with metal inserts that help to stabilize the frame. The frame shrouds several strategic points on the launcher tubes with screws and isolators in a way that moves the single or multi-shot systems together.

The frame itself is lightweight and is easily manufactured and designed with universal mounting slots that are specifically sized to be compatible with the size range of most attachments available in the industry that are typically mounted on weapons systems. This allows for some customization and provides the customer and end user some after market options.

The motor is also accompanied by a rechargeable/swappable 12-24V lithium power supply compatible with the motor requirements. In addition to powering the motor, the 12-24 v lithium power supply provides controlled power of the internal/external components, such as a PCB management system, receivers, optics and laser range finder. The motor, PCB and power supply are encased in a multipiece molded structural plastic housing that is designed for sealing and protecting these components in mission critical weather conditions.

The aerodynamic design of the housing features mounting areas for the components internally that will increase structural rigidity and improve external sealing. The housing, along with many of the sensitive electronic components, have some vibration isolation to protect and preserve the longevity and dependability of the tactical gimbal assembly function.

Ignition of the rocket is achieved by a remote-controlled ignitor that is wired from the on-board controller to the rear of the launcher system where the current fuse is located. The launch of the missile requires multiple safety features to ensure at least a 2-phase action driven by the operator.

OBJECTS AND ADVANTAGES OF THE INVENTION

Considering the forgoing, the remote tactical gimbal targeting system (RTGTS) of the present invention, including the remote weapon station, provides the following advantages over the existing state of the art of lightweight assault weapons, including the M72 LAWS rocket launcher:

- The RTGTS of the present invention is remotely fired, thereby significantly reducing the likelihood of casualties.
- The RTGTS is portable and lightweight.
- The RTGTS can be fired from up to 10 miles away.
- The RTGTS is fully standalone.
- The RTGTS is flexible and easily adapted for use on numerous types of aerial, ground and sea vehicles and other platforms including, but not limited to, drones, ground vehicles, trees, utility poles, and ground supported platforms.
- The RTGTS is fully articulating, traversing left and right and up and down.
- The RTGTS provides targeting camera and laser range finder capabilities with an onboard ballistic proof computer.
- The RTGTS includes a self-destruct function, so that if an enemy tries to recover the system, the motherboard controlling the system can be remotely destroyed.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 2:
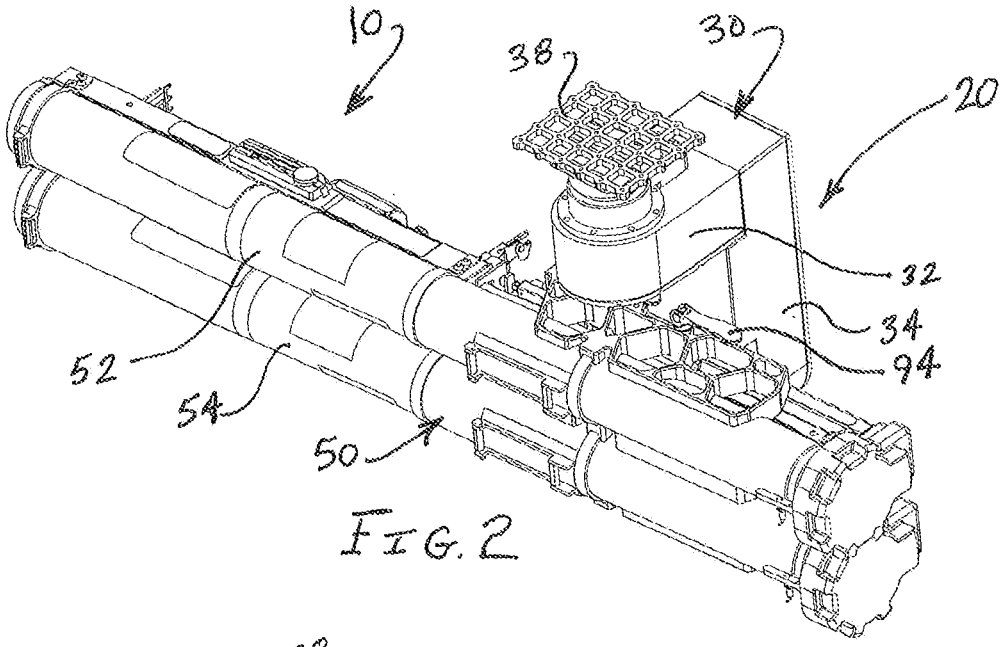
FIG. 2 is a rear, top perspective view of the remote tactical gimbal targeting system of the present invention.
Figure 1:
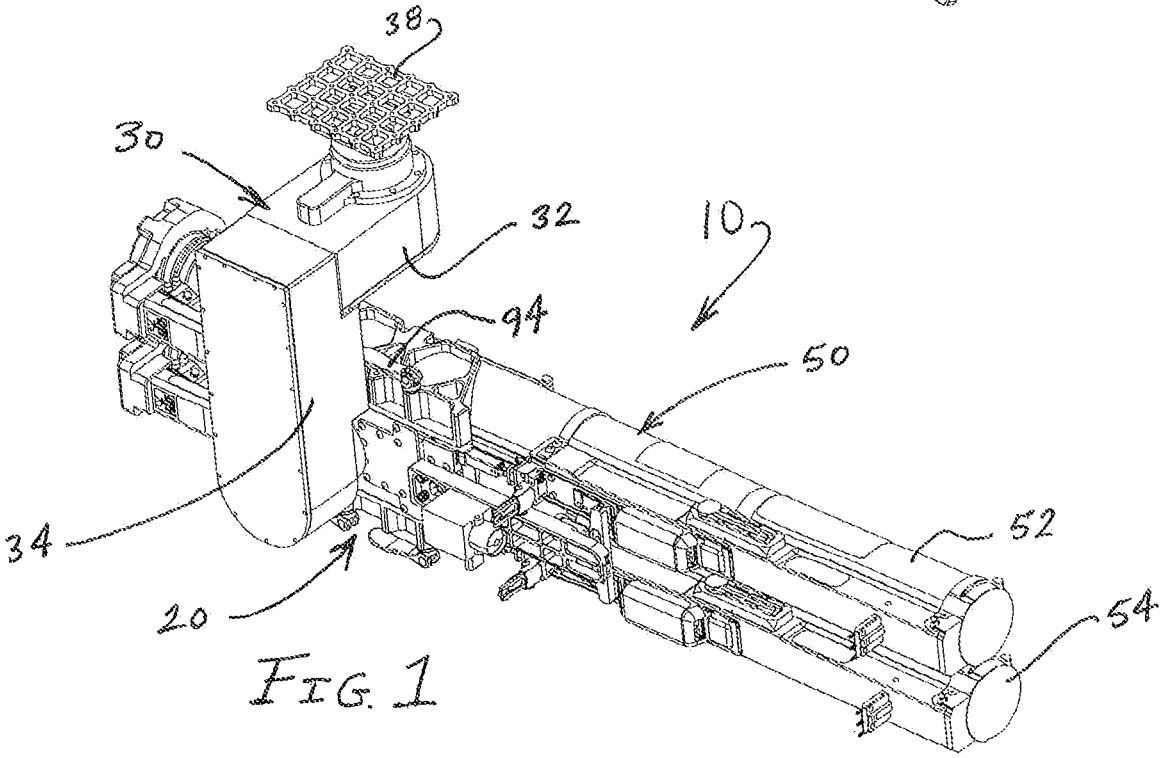
FIG. 1 is a front, top perspective view of the remote tactical gimbal targeting system of the present invention.
Figure 3:
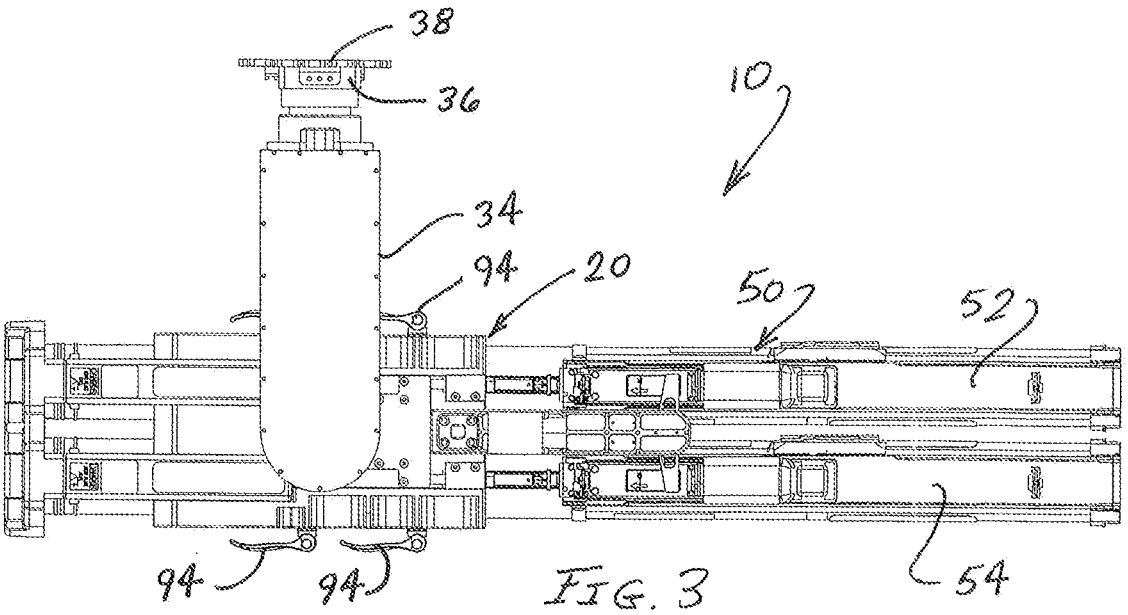
FIG. 3 is a right side elevational view of the remote tactical gimbal universal targeting system.
Figure 4:
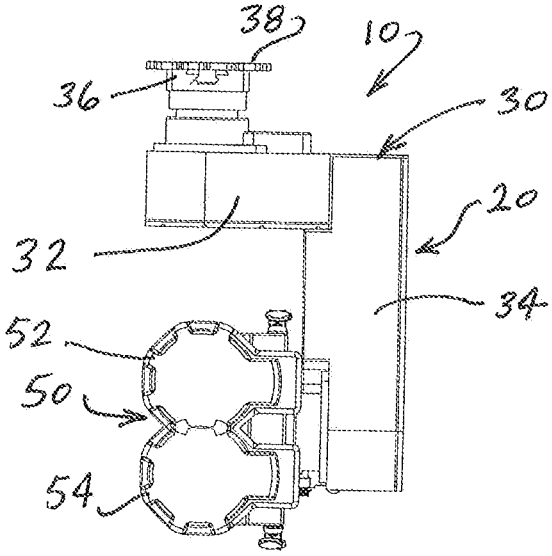
FIG. 4 is a rear elevational view of the remote tactical gimbal universal targeting system.
Figure 5:
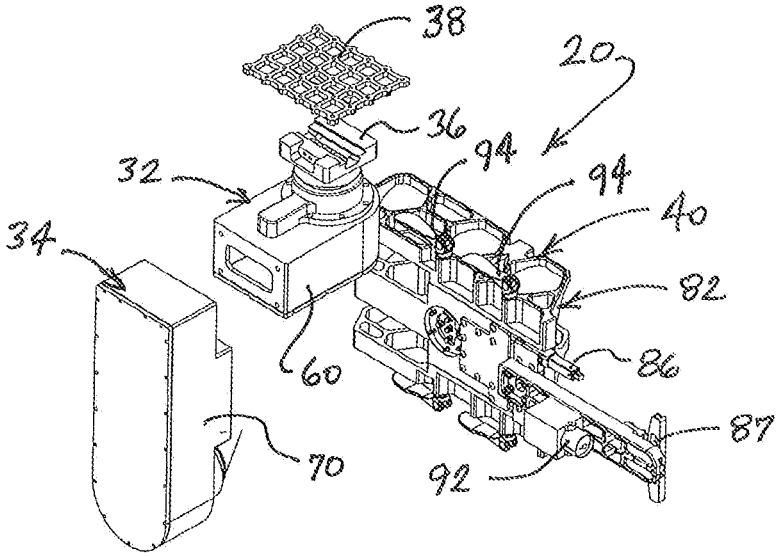
FIG. 5 is an exploded perspective view showing the remote weapon station of the present invention.
Figure 6:
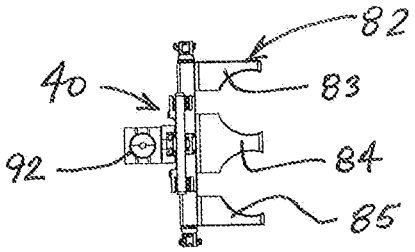
FIG. 6 is a front elevational view of an M72 LAWS attachment structure, also referred to as an M72 receiver.
Figure 7:
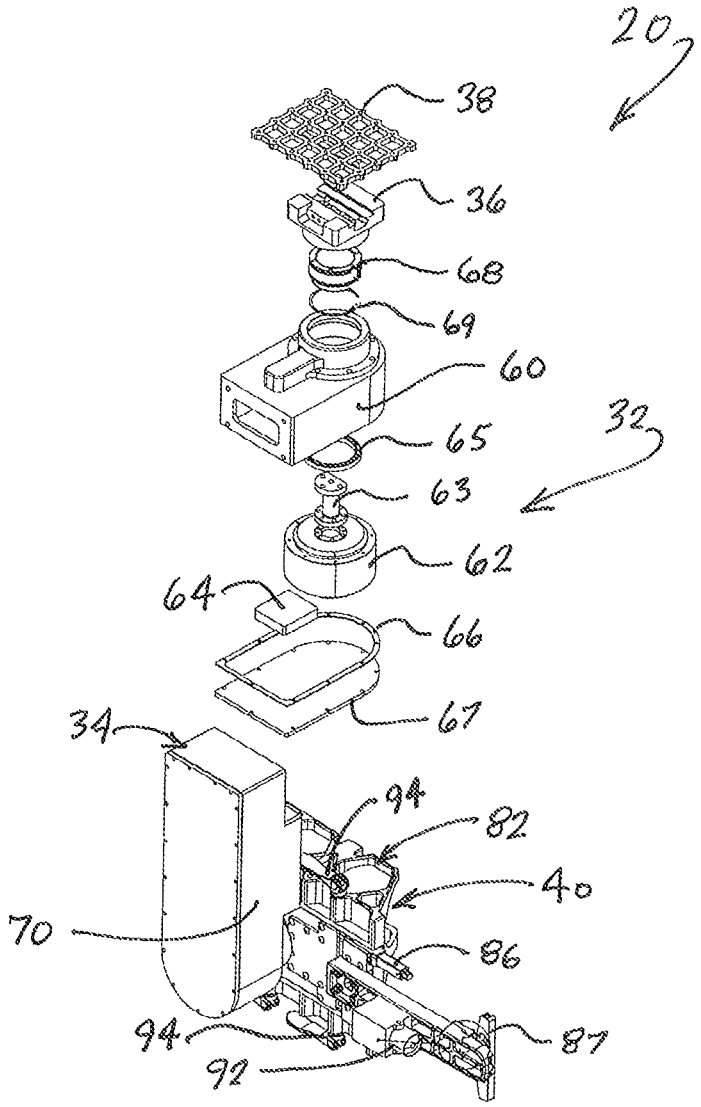
FIG. 7 is a partially exploded perspective view of the remote weapon station showing the components of an azimuth arm and universal mounting plate assembly exploded in relation to a remainder of the remote weapon station.
Figure 8:
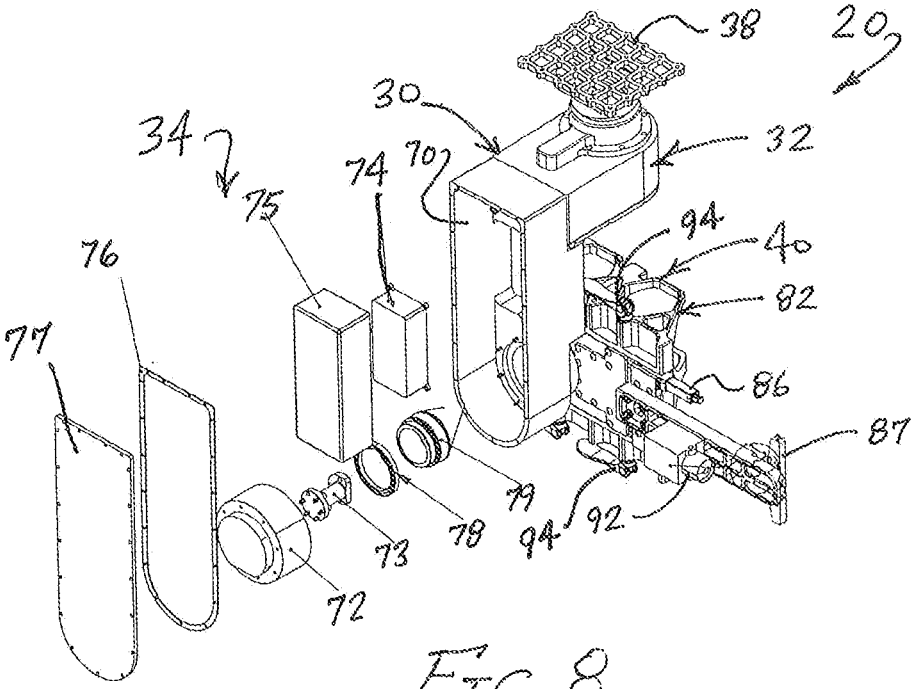
FIG. 8 is a partially exploded perspective view of the remote weapon station showing the components of an elevation arm and electronics exploded in relation to an electronics box and a remainder of the remote weapon station.
Figure 9:
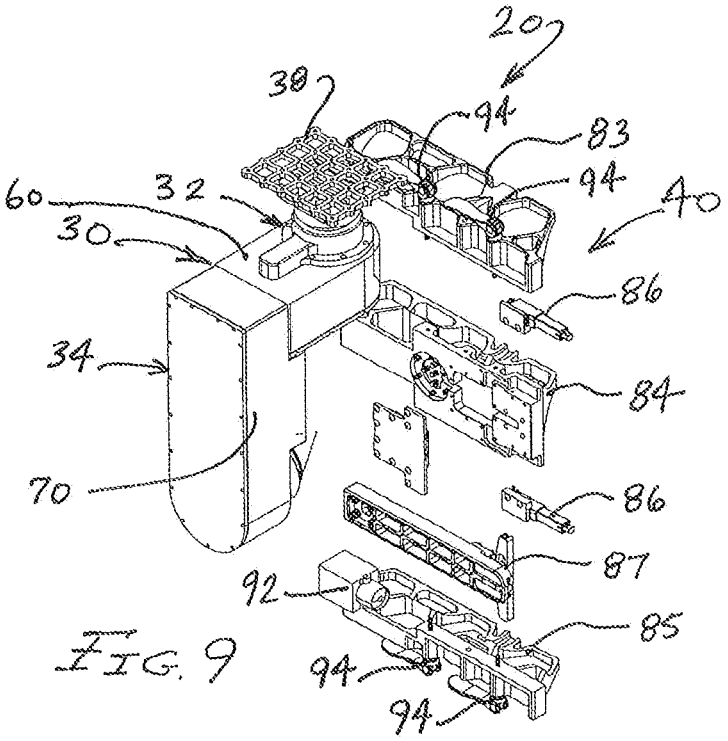
FIG. 9 is a partially exploded view of the remote weapon station showing the components of the M72 LAWS attachment structure and fire trigger assembly exploded in relation to a remainder of the remote weapon station.

Referring to the several views of the drawings, and initially FIGS. 1-4, the fully assembled remote tactical gimbal targeting system (RTGTS) of the present invention is shown and is generally indicated as 10. The RTGTS includes a remote weapon station 20 that is specifically structured for attachment of single or multi-shot anti-armor rocket launcher systems 50 having rocket launcher tubes. The remote weapon station is further structured to be interfaced with aerial, ground and sea vehicles or platforms for operation in mission critical conditions. In the embodiment shown in FIGS. 1-4, the anti-armor rocket launcher system 50 includes two rocket launcher tubes 52, 54, each adapted for firing an anti-armor rocket therefrom.

The remote weapon station 20 includes a tactical gimbal 30 with a 2-axis control system that operates the azimuth and elevation of the tactical gimbal 30 using remotely controlled electromechanical assemblies. More specifically, motors drive the tactical gimbal assembly 30 to position the rocket launcher tubes 52, 54 on a target via laser range finding and live video feedback equipped with a smart reticle system. The control of targeting and the sequence to operate the Fire Control System (FCS) is achieved via a ground control station by an operator. A radio transmitter 64 communicates with the ground control station to send and receive encrypted signals for operation of the several components of the remote weapon station 20 including the azimuth arm 32, the elevation arm 34, as well as a zoom camera with a multispectral lens and laser range finder (LRF) 92. The zoom camera and laser range finder (LRF) are combined in one unit 92. The tactical gimbal 30 includes an azimuth arm 32 for movement of the tactical gimbal in the horizontal, left and right direction, as well as an elevation arm 34 for moving the tactical gimbal vertically, up and down, relative to the mounting vehicle or platform. The components of the azimuth arm 32, including a motor 62 and motor shaft 63, as well as the radio transmitter 64, are contained within a housing 60 that is formed of a lightweight metal or composite material. The housing 60 is enclosed and sealed by a bottom cover plate 67 and bottom seal 66, as well as a top seal 68 and retainer clip 69. The components of the elevation arm 34, including a motor 72 and motor shaft 73, along with a computer 74 and battery 75, are all contained within a housing 70 that is sealed closed with an outer cover 77 and an outer seal 76.

The RTGTS 10 is intended to be interfaced to platforms or vehicles utilizing quick release mechanical systems including, but not limited to, the mil spec picatinny rail system, the ARC rail, morse taper or similar high accuracy interface mounting mechanisms with quick release mechanical separation. A mounting plate 36 with a universal quick attachment 38 having adaptive mechanical fastening points serves as the developmental standard platform for accepting these interface options. Adequate surface area and multi-point interface mounts allow for a stiff and balanced platform to support the weight of the RTGTS 10. The RTGTS 10 is designed to be completely modular, platform agnostic for varying situational mounting operation options and able to operate and be used strategically as an attack or defense platform. The RTGTS 10 can also be mounted standard or inverted, allowing the system to adapt to all types of mount applications. The various platforms that the RTGTS 10 can interface with include, but are not limited to, building structures, tri-pods, trees, light poles, unmanned/manned vehicle systems, oil rigs, and numerous other platforms.

Batteries or other power supply sources are optionally tethered to a main power source 75 or equipped with rechargeable batteries for aerial or active pursuit, or patrol operations and controlled from a remote location. In one preferred embodiment, the main power supply 75 is a 6000 mah rechargeable battery. A main power supply operation, or much larger capacity batteries, can be used for base defense or position defense tactics in a defensive strategy. The rechargeable batteries serve as onboard power supplies for aerials or any remote application needing discrete visualization. The power supply can be integrated to an electronics box or externally configured depending on the capacity requirement per mission. Connectors are universal to adapt to 24 v power supplies. The remote weapon station 20 allows for mounting and control of single or multi-launcher systems 50 from the NAMMO developed line of M72 and A12 family of Lightweight Anti-Armor Weapons System (LAWS) anti-armor rocket launchers. Other similar class size rockets to accept in mounting to the remote weapon station 20 can include, but are not limited to, the RPG7, LRAC, ARMBURST and MATADOR. The individual launcher tubes 52, 54 are positively aligned to the frame 40 of the remote weapon station 20 with the FCS installed and snapped into the receiver 82 on the frame 40 that aligns each launcher tube and the FCS to the optics (i.e., zoom camera and LRF). The platform can also adapt to other launcher systems with custom Fire Control Systems. The current multi-shot array of launchers is configured to adapt up to two launchers. Additional motor and gearbox upgrades are anticipated to drive and aim versions of a RTGTS with three or more rocket launcher tubes. The launcher tubes can be replaced after being expensed and the FCS can continue to be integrated into the next compatible launcher model with no calibration necessary. Wiring from the FCS is discrete and paired with the motor wiring to connect the communication box, which is paired with the power supply.

Targeting is achieved by integrated optics secured to the frame 40 of the remote weapon station 20 that adapts to different launchers and the respective fire control system (FCS), with each launcher tube mounted to the platform individually, but all capable of accurately interfacing with the frame 40. The combined laser range finder (LRF) and zoom camera 92 provide accurate range to target determination and the ability to increase accuracy of success on shots fired from the LAWS rocket launcher assembly. The laser range finder feeds information to the CPU 74 providing position of travel needed, and the tactical gimbal 30 adjusts to range the shot with 400-1000 meters of range accuracy. Motion detection and target acquisition assistance software allows for optimized surveillance and targeting overview. Moreover, motion detection and smart patrol capabilities allows multiple remote weapon station systems to be used in a SWARM or NETWORK driven configuration providing additional visuals and increased response time to threat detection.

The ability to interface to several platforms allows the range of targeting to be adjusted in the field by an operator with toggle sticks on a visually displayed ground control system (GCS) and relay feedback to the onboard CPU 74. The optical sighting (i.e., zoom camera), laser range finding, and fire control features enable vertical elevation of the tactical gimbal 30 to sight the target and trigger the ignition system. Encryption software protects the tactical gimbal's software from being overtaken or scrambled during operation. The GCS also offers up to 16 total channels to view and customize other components for the end user to integrate if wanted.

The remote tactical gimbal targeting system (RTGTS) includes high torque motors 62, 72 with geared shafts 63, 73 and load bearings 65, 78 that provide high positional accuracy and target hold that is stable for the operator to confirm visual targets. Each axis (i.e., azimuth and elevation) has a respective motor assembly capable of positioning the azimuth arm 32 and elevation arm 34 to a target directed by the user via the GCS video feed. The universal mounting plate assembly 36, 38 can be easily secured or detached to the platform of choice using a toolless or a readily available mil standard tool such and quarter turn or Allen key. The motors 62, 72 and gear assemblies 63, 73 control the axis in which the LAWS launcher assembly will rotate. This includes the anti-armor rocket launcher system 50 with rocket launcher tubes 52, 54, as well as the frame 40, camera (optics) and LRF 92, fire trigger 86 and safety actuator 87 which all move in unison. The motor 72 and shaft and gear assembly are secured to the metal or composite frame 40 with metal inserts serving as attachment points that assist in stiffening the frame 40. The frame 40 will shroud several strategic points on the launcher tubes 52, 54 with screws and isolators in a way that moves the single or multi-shot systems together in unison.

The frame 40 is lightweight, quickly manufacturable and designed with universal mounting points and slots that are sized specifically to be compatible with most milspec attachments available in the aftermarket weapons industry typically mounted on armaments. This allows for the frame to adapt for customization. Each launcher tube 52, 54 and its respective FCS are positively aligned to the frame 40 using securing position points for maintaining accuracy of the optics and the FCS. This repeat ability allows for quick swap of rocket launcher tube systems with minimal setup for repeatable operational success. More specifically, the M72 LAWS rocket launcher system attachment structure 82 (i.e., M72 receiver) allows for integration of the LAWS rocket launcher system 50 to the remote weapon station 20 and aligns each launcher tube 52, 54 and the FCS to the optics. The receiver 82 includes a top arm lock 83, a center body holder 84 and a bottom arm lock 85. CAM locks/retainer clips 94 secure the LAWS rocket launcher system to the receiver 82. The receiver 82 is further provided with positioning slots and braces for proper aligned receipt of the launcher tubes 52, 54 onto the receiver 82. The exoskeleton frame structure provides mounting for the motors, communications, computing, optics and FCS. All of which will be sealed or rated to withstand Mil standard environmental ranges.

Ignition of the rocket will be a remote-controlled sequence of operations with built in safety steps. Each systems FCS will have Ground Fire System (GFS) or an Air Fire System (AFS).

GFS is mounted on the system surface and is sealed with FCS that utilizes a linear actuator to arm the safety and a electromagnetic solenoid to actuate the existing trigger on the LAWS rocket launcher. These will be housed in the FCS that snaps onto the launchers and provides an alignment and mounting solution to positively align the launcher tube(s) to the frame 40 and provide a secure attachment. Pigtail attachment of the FCS plugs into the frame that connects to the communication box. Each launcher tube style can have an FCS capable of adapting to a range of launcher tube designs developed by NAMMO. The interface of the FCS to the launcher tube clicks into place and then provides a quick connect surface to align and mount to the frame exoskeleton.

AFS utilizes a firing pin, spring load and manual charging system 86 that can be remotely actuated upon actuation from the GCS. This unit's FCS is attached to the Rocket flash tube and cartridge. An electromechanical linear actuator worm gear drive with a linear actuator shaft face 87 serves as the safety for charging a rear mount FCS. This method provides fail safe bypass to the flash tube and allows for ultimate range of adaptation to units in the field, but may require some alteration. This also provides the ability to reuse the launch tube assembly by inserting a new projectile with flash tube assembly.

The ignitor is wired from the on-board controller to the rear of the launcher system where the current fuse is located. The launch of the missile will require multiple safety features to ensure at least a 2-phase motion driven by the operator.

The final ignition option of the rocket fuse assembly that is remotely controlled by GCS is a CADPAD or an electronics fuse that will heat to a point of actuation the powder contained in the housing connected to the flash tube, thereby providing direct control of the system with extreme accuracy.

Communication includes video, telemetry and system commands of the tactical gimbal 30 and entire remote weapon station 20 will be encrypted AES256 or higher. Currently the GCS utilizes an onboard computer PIXHAWK and command and control signals are transmitted by the HERELINK.

Multiple remote weapon stations 20 can be controlled or monitored by a GCS during operation. This network of communication NETWARRIOR/ATAK or SWARM will provide a network to give visual motion threat detection built into a surveillance system.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A remote weapon station comprising:

a remotely operated targeting apparatus including a base plate for mounting the remote weapon station to a vehicle or platform, and the remotely operated targeting apparatus further including a tactical gimbal that is structured for controlled movement relative to the base plate and vehicle or platform;

a lightweight anti-armor rocket launcher including at least one launcher tube for holding a rocket to be fired at a target;

a frame structure for removably attaching the lightweight anti-armor rocket launcher to the remotely operated targeting apparatus, and the frame structure integrating the lightweight anti-armor rocket launcher with the tactical gimbal to cause the lightweight anti-armor rocket launcher, including the at least one launcher tube, to move in unison with the tactical gimbal; and a remotely operated fire control system for triggering ignition and firing of the rocket from the at least one launcher tube.

2. The remote weapon station as recited in claim 1 wherein the tactical gimbal includes an azimuth arm and an elevation arm, and the azimuth arm being structured for remote controlled movement horizontally, left and right, relative to the base plate and vehicle or platform, and the elevation arm being structured for remote controlled movement up and down relative to the base plate and the vehicle or platform.

3. The remote weapon station as recited in claim 2 further comprising:

a radio transmitter on the remotely operated targeting apparatus for communicating with a remote controller.

4. The remoted weapon station as recited in claim 3 further comprising:

a targeting camera and laser range finder for identifying a potential target and a distance from the remote weapon station to the target.

5. The remote weapon station as recited in claim 4 further comprising:

a computer on the remotely operated targeting apparatus and structured for communication with the radio transmitter, and the computer receiving and processing data from the targeting camera and laser range finder, and the computer further communicating with and controlling the fire control system.

6. The remote weapon station as recited in claim 5 further comprising:

an onboard main power supply for providing electric power to operate the computer, the targeting camera and laser range finder, the radio transmitter and the azimuth and elevation arm movement.

7. A remote weapon station comprising:

a remotely operated targeting apparatus including a tactical gimbal, the tactical gimbal including an azimuth arm and an elevation arm, and the remotely operated targeting apparatus further including a base plate with a universal quick attachment structure for mounting the remote weapon station to a vehicle or platform;

the azimuth arm including a motor for remote controlled movement of the tactical gimbal horizontally, left and right, relative to the base plate;

the elevation arm including a motor for remote controlled movement of the tactical gimbal up and down relative to the base plate;

the remotely operated targeting system further including a radio transmitter for communicating with a remote controller;

a targeting camera and laser range finder for identifying a potential target and a distance from the remote weapon station to the target;

a lightweight anti-armor rocket launcher including at least one launcher tube for holding a rocket to be fired at a target identified by the targeting camera and laser range finder;

a frame structure for removably attaching the lightweight anti-armor rocket launcher to the tactical gimbal, and the frame structure integrating the lightweight anti-armor rocket launcher with the tactical gimbal to cause the lightweight anti-armor rocket launcher, including the at least one launcher tube, to move in unison with the tactical gimbal; and a fire control system operated by the remote controller to trigger ignition and firing of the rocket from the at least one launcher tube.

8. The remote weapon station as recited in claim 7 further comprising:

a computer on the remotely operated targeting apparatus and structured for communication with the radio transmitter, and the computer receiving and processing data from the targeting camera and laser range finder, and the computer further communicating with and controlling the fire control system.

9. The remote weapon station as recited in claim 8 further comprising:

an onboard main power supply for providing electric power to operate the computer, the targeting camera and laser range finder, the radio transmitter and the azimuth and elevation arm movement.

10. The remote weapon station as recited in claim 9 wherein the onboard main power supply includes at least one rechargeable battery.

* * * * *